United States Patent [19]

Kramer

[11] 4,226,008

[45] Oct. 7, 1980

[54] FASTENER FOR BANDS OR THE LIKE

[75] Inventor: Friedhelm Kramer, Ennepetal-Milspe, Fed. Rep. of Germany

[73] Assignee: Schaeffer-Homberg GmbH, Wuppertal, Fed. Rep. of Germany

[21] Appl. No.: 949,049

[22] Filed: Oct. 6, 1978

[30] Foreign Application Priority Data

Oct. 12, 1977 [DE] Fed. Rep. of Germany ..... 2745820

[51] Int. Cl.[2] ..... A44B 19/00; A41D 1/06

[52] U.S. Cl. ..... 24/206 B; 2/237

[58] Field of Search ..... 24/206 B, 191, 206 R; 2/237

[56] References Cited

U.S. PATENT DOCUMENTS 3,872,554 3/1975 Wolfertz ..... 24/206 B

FOREIGN PATENT DOCUMENTS 2408018 8/1975 Fed. Rep. of Germany ..... 24/206 B 1176141 4/1959 France ..... 24/206 B 921988 3/1963 United Kingdom ..... 24/206 B 1206617 9/1970 United Kingdom ..... 24/206 B

*Primary Examiner*—William E. Lyddane

*Attorney, Agent, or Firm*—Martin A. Farber

[57] ABSTRACT

Fastener for bands or the like, particularly on pants, shirts, pockets or the like, comprising a rail provided with catches and a slide running on the rail, which slide has an angular-shaped folding lever, the shorter angle leg of which engages in the catch recesses of the rail in the folded-up position of the folding lever; the folding lever has a window-like opening for the free passage therethrough of a cover strip, the latter lying on the outside in front of the rail, such that the window opening - frame leg, which frame leg points to the slide bottom plate, engages in the catch recesses of the rail on its center section. In the locked position of the folding lever, the window opening - frame leg extends in the parallel flat-position relative to the cover of the rail guide tunnel.

8 Claims, 5 Drawing Figures

FASTENER FOR BANDS OR THE LIKE

Figure 1:
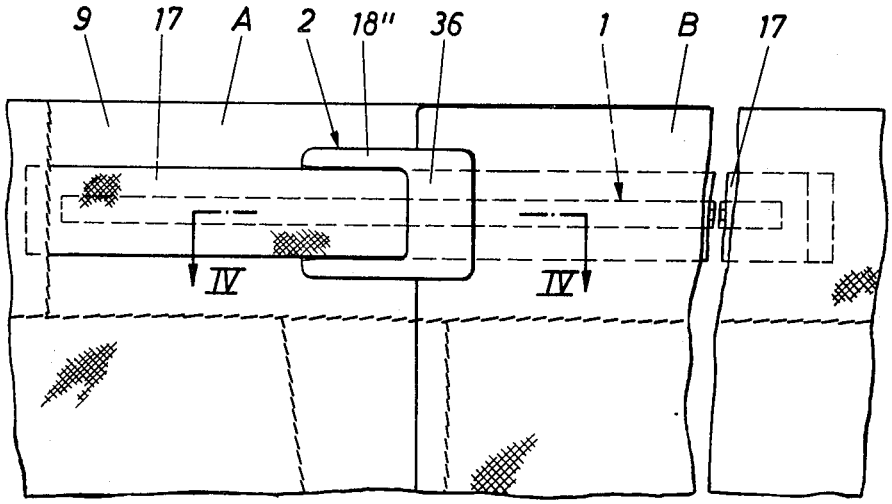

Fastener for bands or the like, particularly on pants, shirts, pockets or the like, comprising a rail provided with catches and a slide running on the rail, which slide has an angular-shaped folding lever, the shorter angle leg of the folding lever engaging in the catch recesses of the rail in the folded-up position of the folding lever, and with which fastener the folding lever has a window-like opening for the free passage therethrough of a cover strip, the latter lying on the outside in front of the rail, such that the window opening-frame leg, which frame leg points to the slide bottom plate, engages in the catch recesses of the rail on the center section of the frame leg.

As a consequence of this formation the catch means are withdrawn from sight. The cover strip which covers the catch means is set through a window-shaped opening of the folding lever in a course which does not prevent the operation of the fastener. The strip whereby covers the rail which has the catch recesses, the catch projection of the folding lever and the slider bottom plate. The window plane lies transversely and slightly inclined, respectively, relative to the cover strip. Consequently the narrow edges of the window opening form the contact surfaces with the cover strip, which, depending upon the material used for the cover strip, under the circumstances can lead to immediate wear.

It is an object of the present invention to construct a fastener according to this type in a manner which is simple in manufacturing, and advantageous in use, without increasing its construction form, such that a wear-free guiding of the cover strip is obtained.

This task is solved by the invention set forth in claim 1.

The dependent claims constitute advantageous additional formations of the subject matter of the invention.

In this manner an extremely low wear cover strip-pass is achieved. The cover strip pass supports itself in the locking position in a relatively wide-surface manner on the window opening-frame leg which then runs in a parallel flat position relative to the cover of the guide tunnel of the rail. In this practically main or predominant position the cover strip no longer engages against a relatively sharp narrow edge of the window opening. The relative movements (when also small) between the frame leg and the cover strip consequently do not lead to the occurrence of wear even with cheaper material for the cover strip. The construction form can be held more compactly, since practically the window opening-frame leg edge, which is directly connected to the catch projection, only still is projected over by the cover strip and the lateral legs, which legs are to be held relatively flat. The parallel window opening-frame leg edge may be shifted back so far in the range of the gripping handle of the fastener that the edge lies in the vicinity of the end section, the latter lying on one end of the band anyway. A correspondingly large window opening has the advantage that the fastener appears optically smaller in the foreground. Beyond this larger window opening brings the advantage of a simplified assembly or mounting.

In order also to protect the narrow edges of the cover strip against wear, the outlet-sided end zones of the window opening-frame leg transfer with a funnel-shaped course into the ascending lateral legs of the window opening. Between the winding opening-frame leg which is aligned in the flat position relative to the cover wall of the rail guide tunnel and the adjoining lateral legs, likewise as a result there is produced a large surface support zone for the cover strip.

By the further construction measure that the catch projection of the fastener is aligned sloping downwardly inclined relative to the plane of the adjoining window opening-frame leg, a favorable upper-dead point position is achieved, the upper dead point position achieving a type of self or automatic locking. On the other hand by the thus provided angling-off or bending in the pivotal range of the folding lever, this zone is stabilized in a particular manner. In the manner that the window opening-frame leg has a convex arch viewed in the longitudinal direction of the rail, the natural course of the arch of the cover strip is taken into consideration.

Figure 2:
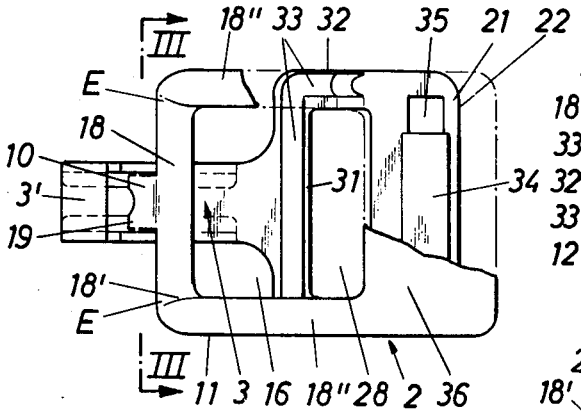
Figure 3:
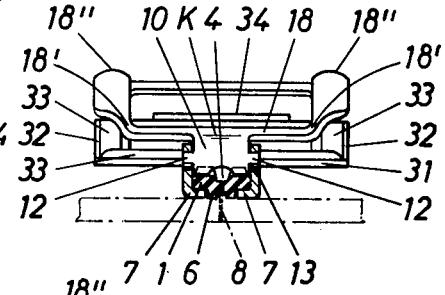
Figure 4:
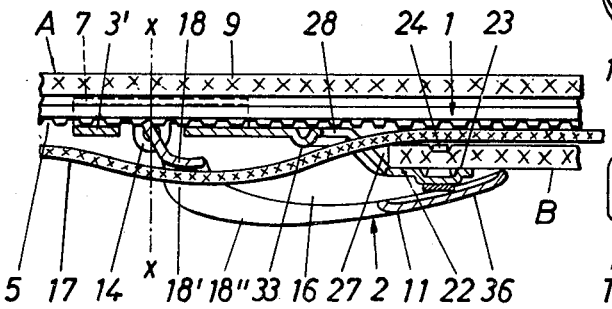
Figure 5:
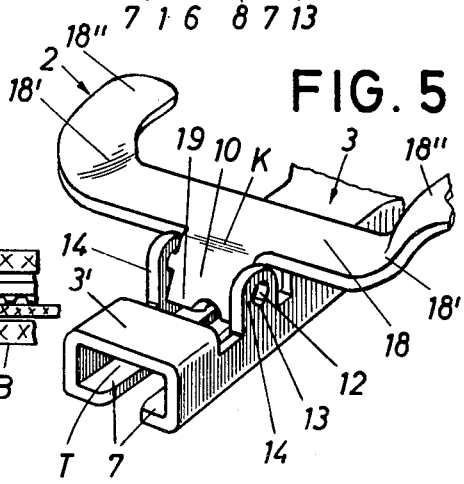

Further advantages and details of the subject matter of the invention are more closely explained in the following on the basis of one embodiment example which is shown drawing-wise. It shows:

FIG. 1 is the fastener which is formed in accordance with the invention on a trouser band, FIG. 2 is a plan view of the fastener in detail illustration and in a scale which is enlarged with respect to FIG. 1, FIG. 3 is a section according to the line III—III in FIG. 2, however with the rail, FIG. 4 is a section according to the line IV—IV in FIG. 1, and FIG. 5 is the fastener in perspective, partial illustration with illustration of the rail guide tunnel with a folding lever articulated in the range of the cover.

The fastener which is guided slide-like on a closely toothed catch rail 1 has a folding lever 2 as well as a slider bottom plate 3 which mounts the lever.

The rail 1 has transversely disposed catch recesses 5, the catch recesses 5 being divided by a centrally extending sew-on recess 4. The base 6 of the rail is indented or contracted. This contraction is gripped behind by the guide tabs 7, the latter being bent-off in double from the slide bottom plate 3, i.e. from its cover 3'. The cover 3' and the guide tabs 7 form a C-like profiled guide tunnel T (compare FIG. 5).

The slide bottom plate is shifted over the front or face end of the rail. A seam 8 holds the rail 1 and consequently the fastener at one end A of the waistband 9 of the pants.

The angle-shaped folding lever 2 has a shorter angle leg 10 and a longer angle leg 11. These legs lie at an obtuse angle with respect to one another.

The tilting or folding axle is formed by projections 12 of material of the shorter angle leg 10, which material projections 12 are taken into consideration during the stamping or pressing-out manufacturing operation. These material projections project as axles into side walls 14 of the cover 3' of the sliding bottom plate 3, the side walls 14 forming the bearing bores 13 of the bearing eyes. The bearing eyes are correspondingly taken into consideration during the stamping or pressing-out operation. For mounting or assembling, the bearing tabs are slightly pressed outwardly. After congruent alignment of the material projections 12 relative to the bearing bores 13, the bearing eyes are again pressed back into the parallel position, which is evident from FIG. 5. The folding lever 2 is then mounted on the sliding bottom plate 3 without being able to come out and get lost.

In the area of the folding axle, the substantially rectangular folding lever 2 has a window-shaped substantially square opening 16. This opening permits the free passage therethrough of a cover strip 17, the latter being secured with its free ends on the band 9, the cover strip being arranged on the outside in front of the rail 1. This cover strip 17 which has a corresponding width, not only covers the rail 1, but even substantially covers the sliding bottom plate 3 as well as the folding axle-sided window opening-frame leg 18 from sight.

In the closed position of the folding lever 2, the window opening-frame leg 18 occupies a parallel, flat-position with respect to the cover 3' of the guide tunnel T of the rail, so that the cover strip 17, which runs through the window-shaped opeing 16, in this position has a relatively large area engagement surface for the cover strip.

The window opening-frame leg continues over the slightly rounded bending zone K into the shorter angle leg 10, the latter projecting into the guide tunnel T of the rail, with the angle leg 10 transferring or passing with its rail-side end section into a projection 19, the latter folding into the catch recesses 5 of the rail 1. The projection and the shorter angle leg are of the same width. This width amounts to somewhat less than the inner open cross-section of the guide tunnel of the rail.

In the locking position the catch projection 19 steps over the dead point line X—X (compare FIG. 4). Upon reaching the dead point position, the rail 1 is compressed stronger. As evident from FIG. 4, with respect to the projection 19 only a very short length of the lever exists, which length is opposed by the far larger length of the lever of the actuation handle. The folding axle is disposed in the lower one-third of the shorter angle leg 10.

In the fastening position the longer angle leg 11 of the folding lever steps against an abutment surface 21 and against the end B of the waistband 9, respectively. The abutment surface is formed from a tongue 22, the latter being step-like offset toward the front, the tongue being integral materialwise with the sliding bottom plate 3. The end B of the band 9 lies on the inner surface 23, the latter being opposite to the abutment surface. The band 9 is held by a clamp 24. The clamp 24 even could be formed or attached directly to the tongue 22. The fastening space 27 for the fastening end B of the waistband arises by the stepping of the tongue 22.

The sliding bottom plate also has an opening 28 for the free passage therethrough of the cover strip 17, which cover strip consequently covers the section of the rail which lies behind the band 9. The guide tunnel-side frame leg 31 as well as the two frame legs 32 which run in the direction of extension of the rail, are stabilized by means of a pressed-out or embossed rib 33. The corresponding embossed rib also extends over the rising section of the tongue 22. The higher section of the tongue 22 is stabilized by means of an outer-sided projecting-out portion 34. One passage opening 35 each for the clamp 24 is located on the face side of the projection 34.

That section of the sliding bottom plate 3 which has the opening 28, and the folding lever 2 which covers the sliding bottom plate 3, are of the same width; the section of the bottom plate 3 which forms the guide tunnel T of the rail, to the contrary is only approximately one-third of this width.

As evident from FIG. 4, the window opening-frame leg 18 is stabilized by means of a convex arching viewed in the longitudinal direction of the rail 1. This arch also corresponds to the course of the arch of the cover strip 17 there, which strip in the area of the waistband end B again runs up to the rail.

The folding axle-side end zones E of the window opening-frame leg 18 are bent up. In this manner the end zones form relatively large-surface side guides for the cover strip. These rising sections 18' moreover are widened in a funnel-like manner (compare FIG. 2) and continue into the transversely-arched side legs 18'', in order to go over or pass into the window opening-frame leg 36, the frame leg 36 extending parallel to the window opening-frame leg 18. The frame leg 36 forms an actuation handle. This frame leg 36 also has a convex arch, the latter being viewed in the longitudinal direction of the rail 1 (compare FIG. 4).

For the purpose of enlarging the extent of the waistband, the folding lever 2 is to be grabbed under on its free end section and is to be folded forwardly. In this manner the shorter angle leg, i.e. its projection 19 steps out of engagement from the rail 1. The fastener can then be shifted in the desired direction in order to be fixed anew in the above-described manner.

If such a fastener is used on pockets, bandages or belts, thus the right-side end of the cover strip is to be reversibly fixed (snap-button fastener or clinging fastener) either on one or the other end of the band, while the left-side end of this cover strip is fixed as before by sewing on or the like.

I claim:

1. Fastener for bands or the like, particularly on pants, shirts, pockets or the like, comprising a rail having catches defining catch recesses, a slide running on said rail, said slide having a slide bottom plate defining a rail guide tunnel, said rail extending through said guide tunnel, said slide having a cover covering said rail guide tunnel, an angular-shaped folding lever being pivotally mounted to said slide, said folding lever having a longer leg constituting lever actuation handle and a shorter angle leg, the latter carries a catch projection engaging in said catch recesses of said rail in a folded-up locked position of said folding lever, said longer leg of said folding lever having frame legs defining a window opening in said longer leg, the latter being adapted for the free passage therethrough of a cover strip, the latter lying on the outside in front of said rail, one of said frame legs points to said slide bottom plate and carriers said shorter angle leg, the latter via said catch projection engaging in said catch recesses of said rail, said one frame leg is angled-off such that in said locked position of said folding lever said one frame leg extends in a substantially parallel flat position relative to said cover of said rail guide tunnel and to the cover strip.

2. The fastener according to claim 1, wherein said frame legs include rising lateral legs of the window opening, said lateral legs rising relative to said one frame leg, said one frame leg has end zones which transfer in a funnel-shaped course into said rising lateral legs of the window opening.

3. The fastener according to claim 1, wherein said one frame leg substantially defines a plane, said shorter angle leg and catch projection are inclined downwardly and angularly relative to said plane of said one frame leg, the latter integrally adjoining said shorter angle leg and said catch projection, whereby a dead point position is achieved providing a locking biasing of the folding lever in the locked position.

4. The fastener according to claim 1, wherein said one frame leg is convexly arched in the longitudinal direction of said rail.

5. The fastener according to claim 1, wherein said slide bottom plate includes lateral sides extending from said cover formed with bent tabs, respectively, aligned spaced apart pointing to each other, forming said guide tunnel therein.

6. The fastener according to claim 1, wherein said shorter angle leg and said longer angle leg form an obtuse angle therebetween.

7. The fastener according to claim 6, wherein said shorter angle leg is integrally formed with aligned axles projecting laterally from oppsite sides, said axles are formed in a lower one-third free end portion of said shorter angle leg, said slide is formed with projecting tabs defining bearing openings adjacent said rail guide tunnel, said axles are pivotally mounted in said bearing openings.

8. The fastener according to claim 1, wherein said slide has a stepped-up portion remote from said guide tunnel defining a slide opening, clamp means for connecting said stepped-up portion of said slide to one end of the band, said rail is sewed-on to the other end of the band defining a space between said rail and said one end of the band in an overlapped position of the ends of the band, and in the locked position said cover strip substantially flatly abuts said one frame leg, extending through said window opening of said folding lever, said slide opening and said space between said rail and said one end of the band.

* * * * *